United States Patent [19]

Keith, Jr.

[11] 3,938,283

[45] Feb. 17, 1976

[54] DUST BAG SUPPORT

[75] Inventor: James A. Keith, Jr., Pickens, S.C.

[73] Assignee: The Singer Company, New York, N.Y.

[22] Filed: Feb. 24, 1975

[21] Appl. No.: 552,467

[52] U.S. Cl...... 51/170 R; 51/170 TL; 51/170 MT; 51/273

[51] Int. Cl.[2]..... B24B 23/00; B24B 55/06

[58] Field of Search ..... 51/170 R, 170 PT, 170 T, 51/170 TL, 170 EB, 170 MT, 270, 273; 248/95

[56] References Cited

UNITED STATES PATENTS

| | | | |
|---|---|---|---|
| 2,143,970 | 1/1939 | Blood | 51/170 T |
| 2,252,160 | 8/1941 | Blood | 51/273 |
| 2,829,734 | 4/1958 | Brace | 248/95 X |
| 3,049,842 | 8/1962 | Murschel | 51/170 EB |

*Primary Examiner*—James L. Jones, Jr.
*Attorney, Agent, or Firm*—Marshall J. Breen; Edward L. Bell; Harold Weinstein

[57] ABSTRACT

A support for a dust bag for use in connection with an electrically driven surface treating machine to collect dust created by the machine during operation which comprises a rod member detachably connected to an exhaust conduit on the machine. Means are provided to insure proper positioning or alignment of the dust bag support so that the support may function to hold the dust bag up and away from the work piece so as not to interfere with the operator in using the machine.

4 Claims, 6 Drawing Figures

DUST BAG SUPPORT

BACKGROUND OF THE INVENTION

Electrically driven portable surface treating machines such as a sander, polisher, buffer and the like have an oscillatable platen which creates dust during use which is normally allowed to enter the ambient air in a work area. There has been a long standing need for improving the constructional arrangement of such machines so as to provide for the collection of such dust. A number of dust bags have been proposed but the proper support for such dust bags did not meet the requirements for successful use and sale of the machine. What was found wanting in the prior art was a support which holds the bag so as to not interfere with the operation of the machine during use yet which is readily detachable and easily replaced and properly positioned on the machine. The support must also permit emptying of the dust bag without removal of the support and at this same time be inexpensive and simple in construction.

SUMMARY OF THE INVENTION

It is an object of this invention to provide a dust bag support for an electrically driven portable surface treating machine which is easy to detach and to reconnect so that the bag is properly aligned upon the reconnection for proper operation of the machine, yet will permit the dust bag to be removed and replaced without detachment of the support from the machine.

It is the further object of this invention to provide a support for a dust bag for a surface treating machine which is inexpensive and simple for an operator to handle.

The present invention provides a support for a dust bag for an electrically driven portable surface treating machine and comprises a rod member suitably formed to provide a resilient loop attachment to an exhaust conduit properly positioned on the machine and to provide a support for the dust bag so as not to interfere with the operation of the machine.

DESCRIPTION OF THE PREFERRED EMBODIMENT

Figure 1:
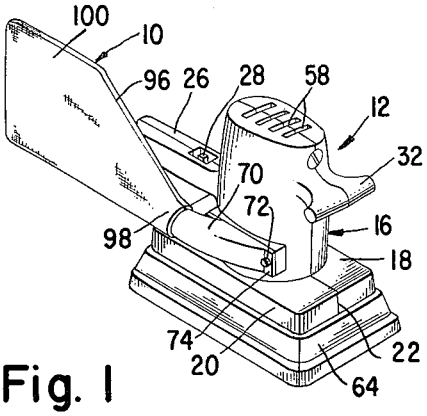
FIG. 1 is a perspective view of a surface treating machine showing to advantage the dust bag and its support connected thereto.

In the illustrated embodiment of the invention in FIG. 1, there is shown a dust bag 10 shown attached to an electrically driven portable surface treating machine, indicated in its entirety as 12.

In order to understand the operation of the dust bag 10 and more importantly the dust bag support 14 shown more clearly in FIGS. 3–6, the portable surface treating machine 12 to which it is attached will be explained first.

Figure 2:
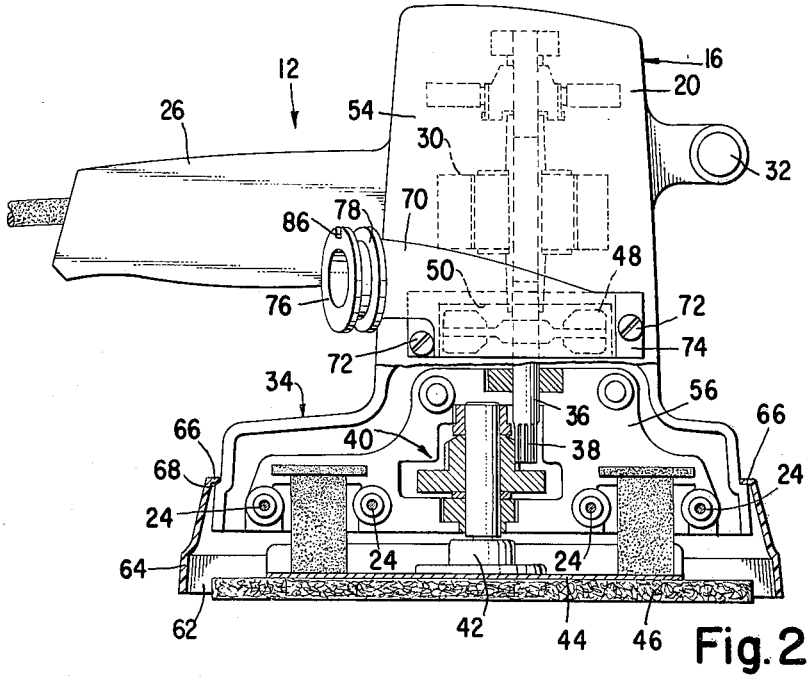
FIG. 2 is an enlarged side elevational view, with a portion of the housing partly broken away and partly in section to illustrate the working parts within the machine shown in FIG. 1, but with the dust bag and its support removed.

In this illustration, the surface treating machine 12 is depicted as a sander with a clam shell housing 16 comprising a pair of complementary halves 18 and 20, which are detachably connected along a longitudinal split 22 by carriage bolts 24 shown in cross section in FIG. 2. A main handle 26 formed integral with the housing 16 is provided with an operator controlled electric on-off switch 28 between a motor 30 and a suitable source of electric power. A forwardly positioned auxiliary handle 32 is also provided so that the sander can be grasped and controlled by the operator.

The motor 30 drives a platen assembly 34 disposed within the housing at the bottom thereof. An armature shaft 36 of the motor 30 has a pinion 38 formed on its lower end which connects through a gear reduction mechanism 40 to an eccentric bearing bracket 42 which imparts shiftable motion such as oscillatory, reciprocatory, orbital or the like to rectangular rigid back plate 44.

A resilient pad 46 is bonded to a back plate on which is typically mounted suitable sand paper to treat the surface of a work piece. Since the gear reduction mechanism, the resilient pad, the back plate and the manner in which they are operatively attached within the housing, form no part of the present invention, a further description thereof is deemed unneccesary herein.

Located midway of the housing 16, and in the illustrated embodiment, between the motor 30 and the gear reduction mechanism 40, is a fan 48 mounted on the armature shaft 36. Fan 48 serves to induce air through two flow paths in the housing 16 out through a rectangular opening 50 formed in the side 20 of the housing. The longest sides of the rectangular opening 50 are located horizontally and the housing is also provided with an inwardly extending ridge 52 (see FIG. 3) which begins at one vertical edge of the opening 50 which encircles the housing and fan and terminates at the opposite vertical edge of the opening 50. This ridge, by encircling the outer edge of the fan 48 midway of its blades, divides the fan into two functionally distinct parts and also divides the housing into two flow chambers 54 and 56 within the housing walls.

Figure 3:
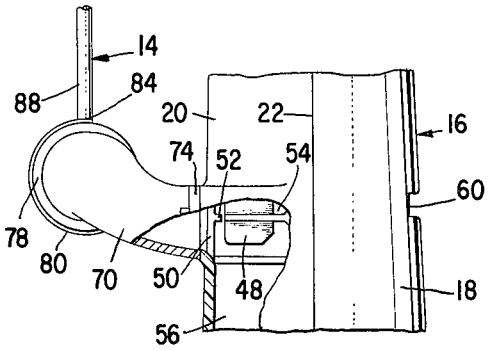
FIG. 3 is a partial elevational view and partly in section to show the machine fan and the input to a discharge conduit.

The first air-flow path in the first flow chamber 54 is through the openings 58 in the top of the housing (see FIG. 1) down past the motor 30 and out the opening 50 and an opening 60 formed inside 18 opposite the opening 50 (see FIG. 3). By having an air flow through two openings 50 and 60, both sides of the motor are suitably cooled.

It should be noted here that the flow of air through the first flow path and out the exhaust conduit, tends to create a low pressure zone near the opening below the ridge 52 so as to create a secondary air flow which aids the flow of air through the second chamber 56. The second air-flow path in the second chamber 56 is through the space 62 near the bottom of the machine around the peripheral edges of the resilient pad 46 and its sand paper and out through the opening 50.

It can be appreciated that during operation of the sander on a work piece, there is an accumulation of dust near the edges of the pad 46 and its sand paper. To gather and hold this dust as much as practical within the machine so as to reduce the amount of dust entering the ambient air, a skirt 64 is positioned around the lower end of the housing 16 and attached thereto in any suitable manner. In the embodiment shown, this skirt 64 is of relatively thin yieldable one-piece plastic material forming a loop, the upper end of which is slightly smaller than the outer periphery of the housing at the point of attachment. To attach the skirt 64 to the housing 16, the skirt 64 is stretched slightly so that its inwardly directed top flange 66 engages a shoulder 68 provided therefor on the housing. Thus, with this skirt 64 whose lower edge is slightly above the lower surface of the pad 46 and sand paper, there is provided the free space 62 through which air may flow.

This air flowing into the space 62 becomes dust-laden and is impelled by the fan 48 out the opening 50 through a sleeve or exhaust conduit 70, of any suitable material, metal or plastic. One end of this exhaust conduit is shaped to encompass the entire periphery of the opening 50 and is fastened to the housing by any suitable means such as screws 72 through suitable openings in the conduit flange 74. The exhaust conduit 70 extends horizontally toward the rear of the machine as shown in the drawings, that is, in the direction of the outer end of the main handle 26 but spaced away from the housing side 20 to accommodate the dust bag and an operator's hand on the handle 26.

The exhaust conduit 70 is provided with a pair of flanges 76 and 78, on the end opposite the opening 50, which form a part of the means for attaching the dust bag 10 and its support 14. These flanges may be an integral part of the exhaust conduit and are spaced apart to receive a portion of the dust bag support 14 as a means of attaching the support to the machine.

Figure 4:
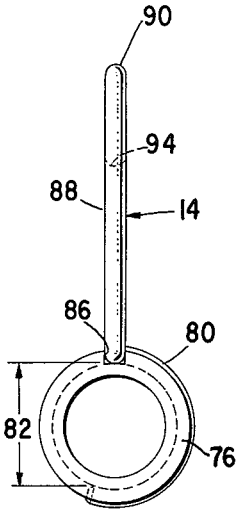
FIG. 4 is a front elevational view illustrating to advantage the dust bag support connected to the outer end of the exhaust conduit.
Figure 5:
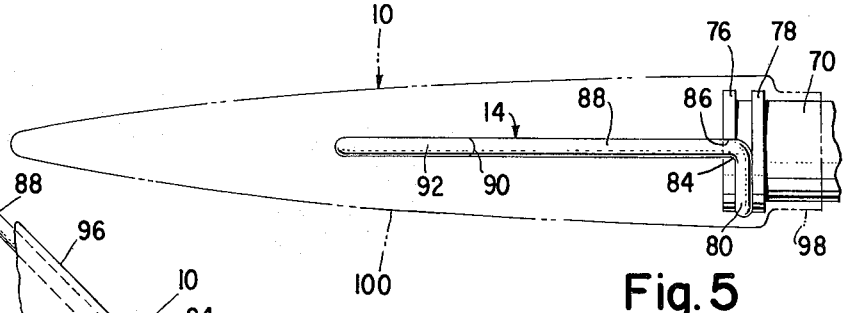
FIG. 5 is a top plan view showing the dust bag support connected to the exhaust conduit, with the dust bag shown in phantom.
Figure 6:
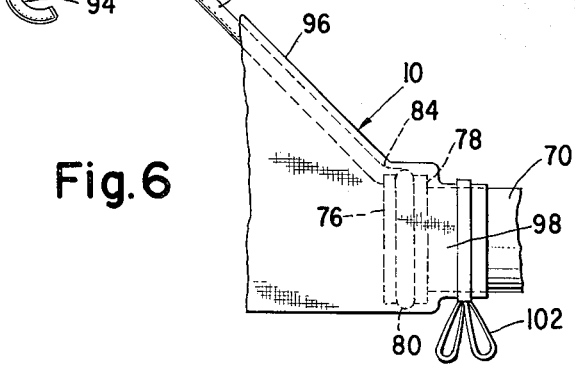
FIG. 6 is a partial elevational view, partly in section, to show the means for supporting and connecting the dust bag on the exhaust conduit.

Turning now particularly to FIGS. 4, 5, and 6, it can be seen that the dust bag support 14 comprises a relatively rigid, yet yieldable, rod member of suitable material such as spring wire provided with a partial loop or torus 80 on one end, the diameter of which is slightly smaller than the outer diameter of the exhaust conduit as clearly shown in FIG. 4.

The loop 80 forms only a portion of a circle or partial loop, the length of the rod material and the diameter of the loop being determined by the amount sufficient to insure proper connection to the exhaust conduit 70 and sufficient to form a throat 82 through which the exhaust conduit may pass by expanding the throat due to the resiliency of the rod material. In the embodiment shown, the rod material extends slightly more than one-half of the periphery of the exhaust conduit. The rod member is bent, as at 84, so as to be up and away from the air flow emitted from the exhaust conduit and at 90° from the plane of the loop 80. This bend is immediately adjacent to the loop and also forms part of the alignment means which cooperates with an alignment notch 86 at the top of flange 76. Bend 84 also forms a leg 88, the length of which is determined by the size and shape of the dust bag to be used therewith. The rod member is bent at the end of the leg 88 slightly, as at 90, to form a second leg 92 disposed in a horizontal direction, i.e., in a direction parallel to the main flow of the air flow emitted from the exhaust conduit. Leg 92 terminates in a second loop 94 which is formed simply to facilitate the insertion of this support 14 within the dust bag 10, while leg 88 facilitates entry of the dust-laden air into the dust bag.

In the embodiment shown, the dust bag 10 of conventional material is of a generally oblong, relatively thin shape, formed with a diagonal leading edge 96 which terminates forming an inlet 98 which is tubular when mounted on the support 14. The diagonal 96 conforms generally to the length of the leg 88 of the support while the upper edge 100 extends beyond the loop 94. The inlet 98 is sufficiently large to slip over the flanges 76, 78 and the loop 80. To fasten the dust bag to the exhaust conduit, a suitable tie 102 is provided which is tied in a conventional manner around the exhaust conduit 70 as shown in FIG. 6.

From the foregoing, it can be seen that there is provided a readily detachable bag 10 and support 14 for a portable surface treating machine 12. The bag is readily removable by simply untying the string 102 and pulling the bag away from the exhaust conduit 70 and away from support 14. If it is desired to remove the detachable support 14, it is simply a manner of forcing the resilient loop 80 out of the nesting place between the flanges 76 and 78. When the support is reconnected, the aligning notch 86 on the outer flange 76 serves to position the support with respect to the exhaust conduit 70 as can be seen in FIGS. 4 and 5.

From the foregoing, it will be seen that the dust bag and its support are both readily detachable; that this support is simple in construction, and is provided with an easy means of positioning on the machine.

What is claimed is:

1. A portable sanding tool having a motor driven oscillating platen carried by a housing, and means for discharging from the housing dust-laden air created by the use of the tool upon a work surface comprising:

a. a discharge conduit rigidly connected to the housing, b. at least one radial flange formed on the outer periphery of the discharge conduit, c. notch means formed in the flange of the discharge conduit, d. a support rod including an arcuate section defining an expandable throat, and a straight section, e. the straight section of the support rod disposed in the notch means of the flange to permit the arcuate section of the support rod to encircle the discharge conduit adjacent the flange, and f. a dust bag detachably connected to the discharge conduit and supported by the support rod.

2. The combination claimed in claim 1 wherein:

a. means engaged between the discharge conduit and the support rod to prevent the straight section of the support rod from being dislodged from the notch means, and b. said last mentioned means includes a second radial flange spaced from and adjacent to the first radial flange whereby a recess is formed therebetween to receive the arcuate section of the support rod.

3. The combination claimed in claim 2 wherein:

a. the support rod is bent at substantially 90° adjacent the junction of the arcuate section and the straight section, and b. the straight section is formed to extend upwardly and outwardly from the arcuate section.

4. The combination claimed in claim 3 wherein:

a. the notch means is formed adjacent the vertical top of the discharge conduit whereby the support rod is held in position with the straight section thereof extending vertically upwardly and away from the discharge conduit and holds the dust bag in like position freely to receive the dust-laden air and collect the dust therein.

* * * * *